US008801466B2

(12) United States Patent
Wimmer et al.

(10) Patent No.: US 8,801,466 B2
(45) Date of Patent: Aug. 12, 2014

(54) ELECTRICAL DISTRIBUTION DEVICE AND METHOD FOR FITTING THE SAME

(71) Applicant: Phoenix Contact GmbH & Co. KG, Blomberg (DE)

(72) Inventors: Michael Wimmer, Kremmen (DE); Martin Kneidl, Detmold (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 40 days.

(21) Appl. No.: 13/707,848

(22) Filed: Dec. 7, 2012

(65) Prior Publication Data

US 2013/0102183 A1 Apr. 25, 2013

Related U.S. Application Data

(63) Continuation of application No. PCT/EP2011/059588, filed on Jun. 9, 2011.

(30) Foreign Application Priority Data

Jun. 9, 2010 (DE) ..... 10 2010 017 311

(51) Int. Cl.
*H01R 13/648* (2006.01)

(52) U.S. Cl.
USPC ..... 439/607.34; 439/607.56

(58) Field of Classification Search
USPC ..... 439/607.34, 607.56, 95
See application file for complete search history.

(56) References Cited

U.S. PATENT DOCUMENTS

| | | | | |
|---|---|---|---|---|
| 5,244,415 | A * | 9/1993 | Marsilio et al. | 439/607.47 |
| 5,906,513 | A * | 5/1999 | Peterson et al. | 439/607.58 |
| 5,975,955 | A * | 11/1999 | Bogiel et al. | 439/607.56 |
| 6,629,858 | B2 * | 10/2003 | Lo et al. | 439/607.56 |
| 6,739,882 | B2 * | 5/2004 | Fuehrer et al. | 439/95 |
| 2011/0143593 | A1 * | 6/2011 | Liu et al. | 439/607.34 |
| 2013/0017724 | A1 * | 1/2013 | Liu | 439/607.34 |

FOREIGN PATENT DOCUMENTS

| | | |
|---|---|---|
| DE | 38 22 573 | 1/1990 |
| WO | WO 2010/060608 | 6/2010 |

* cited by examiner

*Primary Examiner* — Gary Paumen
(74) *Attorney, Agent, or Firm* — Woodard, Emhardt, Moriarty, McNett & Henry LLP

(57) ABSTRACT

Disclosed is an electrical distribution device (10), e.g. a distribution piece, for connection to line and/or connecting devices (12) having shielding devices (18), wherein the distribution device (10) having a conductive housing (20) for forming a shielding, and at least one conductor track mount (26, 28), arranged in the housing (20), for connection of line and/or connecting devices (12). The shielding devices (18) can be conductively connected via the conductor track mount (26, 28) to at least one contact element (40, 42) which can be attached to said mount, and the housing has conductive housing parts (36, 38), at least one of which has at least one structure (46, 48) which has at least one elastic contact projection (50, 52) for making electrical contact with the attached contact element (40, 42), and another of the housing parts (38, 36) has at least one clamping device (56, 54) with two jaws (58, 60) for clamping the contact projection (50, 52) to the attached contact element (40, 42) when the housing parts (36, 38) are joined. Methods for fitting a corresponding electrical distribution device (10) are also disclosed.

12 Claims, 2 Drawing Sheets

ELECTRICAL DISTRIBUTION DEVICE AND METHOD FOR FITTING THE SAME

CROSS-REFERENCE TO RELATED APPLICATIONS

This application is a continuation of International Application No. PCT/EP2011/059588, filed Jun. 9, 2011, which claims the benefit of German Application No. 10 2010 017 311.8 filed Jun. 9, 2010 the entire disclosures of which are hereby incorporated by reference.

FIELD

The disclosure relates to an electrical distribution device, in particular a distribution piece, for connection to line and/or connecting devices which have shielding devices, wherein the distribution device has a conductive housing for forming a shielding and has at least one conductor track mount which is arranged in the housing for connection of the various line and/or connecting devices.

BACKGROUND

Distribution systems exist for the transmission of electrical signals or also of electrical power from one machine or facility to several other machines or facilities. These distribution systems consist of an electrical distribution device which is designed as a distribution piece, for example, for connection to line and/or connecting devices designed as connectors or lines. For this purpose, the distribution piece is designed as a T-piece or an H-piece, for example. The distribution piece has a conductor track mount inside the housing which is designed as a rigid or flexible circuit board, for example, for the electrical interconnection of the individual conductive elements of the various connectors. With such arrangement, a plastic coating can ensure that the distribution piece is sealed against particles and liquids (Protection Class IP 67). For the coating process, the circuit board is held in position by a one-piece or multipart housing and/or inner housing.

To prevent electrical and magnetic interferences, the distribution piece is provided with an electrically conductive shielding. There are different options for establishing such EMV (electromagnetic compatibility) shielding. A common possibility is that the shielding devices of connectors designed as shielded sleeves are also soldered onto the circuit board and the shielding is therefore linked via the circuit board. Furthermore conductive metal housings are available which are provided with a plastic cover coated with a conductive layer on one side and which are subsequently filled with potting material. A double coating is also known which has an insulating core as well as an outer plastic coating that has been made conductive.

The patent specification U.S. Pat. No. 5,906,513 shows a shielded T-piece for connection on three connectors each of which has a set of conductive elements and one shielded sleeve each, with a conductive housing to form shielding of the T-piece and with a rigid circuit board arranged in the housing for interconnecting the conductive elements of the different connectors to one another, wherein one of the shielded sleeves makes electrical contact with the conductor track mount.

SUMMARY

The object of the present disclosure is to indicate an electrical distribution device and a method for the assembly of same, to ensure secure contacting of the housing forming the shielding with the shielding devices of the line and/or connecting devices as well as an easy assembly.

The present disclosure teaches that this problem is solved by the features of the independent Claims. Advantageous embodiments of the invention can be found in the sub-claims.

The electrical distribution device as taught by the present disclosure provides that the shielding devices are conductively connectable via the conductor track mount to at least one contact element which is attachable to said mount, and the housing has conductive housing parts, wherein at least one of the housing parts has at least one structure with at least one elastic contact projection for making electrical contact with the attached contact element and another of the housing parts has at least one clamping device with two clamping jaws for clamping the contact projection to the attached contact element when the housing parts are joined together. This electrical distribution device ensures that during the assembly of same by joining together the two electrically conductive housing parts, a secure electrical contact of the shielding devices of the line and/or connecting devices results with the conductive housing which forms the shielding of the distribution device, if a corresponding contact element is installed. If no electrical contact of the conductive housing of the distribution device with the shielding devices of the line and/or connecting devices is desired, then the contact element is dispensed with, so that the contact projection "grasps into nothing" and/or the contact projections "grasp into nothing," and the conductive housing and the shielding devices, unless they have electrical contact with each other by means of another path, continue to be electrically insulated from one another. Making electrical contact is therefore optional, which is a further advantage.

The electrical distribution device preferably is a distribution piece, preferably a T-piece or an H-piece. The conductor track mount can also be used for making electrical contact of the contact elements and/or line elements of the line and/or connecting devices to one another. It is in particular designed as a rigid or flexible circuit board.

Preferably it is provided that the conductor track mount comprises the contact element and that the shielding devices are connected electrically conductive via the conductor track mount with the at least one contact element attached to said mount. This configuration with the contact element therefore results in secure electrical contact of the conductive housing of the distribution device and the shielding devices or the corresponding line and/or connecting devices.

Advantageously, two conductor track mounts arranged in parallel are provided, between which the contact element is arranged and wherein the contact element connects these two with one another.

Pursuant to an advantageous embodiment of the disclosure it is provided that the housing parts for forming the conductive housing are designed as two housing halves, in particular as housing half-shells. With such design, the conductive housing and/or the conductive part of a total housing is formed by the two housing halves. Therefore this does not exclude that further, in particular non-conductive housing parts, are present. The conductive housing parts are preferably comprised of metal.

Pursuant to a further advantageous embodiment of the disclosure it is provided that the contact projection and/or at least one of the clamping jaws has a stop bevel for clamping the contact projection together with the contact element. The stop bevel makes it possible to vary the contact pressure of the clamping jaws when they are joined together.

It is provided in particular that the structure is an essentially U-shaped structure with two elastic legs of the contact projections of the U-shape designed for circumferentially gripping and/or "capturing" the contact element, and the clamping jaws is designed as clamping jaws for clamping the legs on both sides for locking the legs in position with the contact element when joining together the housing parts. If the housing parts are housing halves and/or housing half-shells, then the U-shaped structure circumferentially grips the contact element which is in electrical contact and attached to the conductor track mount from one side. If the second housing half is mounted subsequently, then its clamping device circumferentially grips the end sections of the U-shaped structure with the two clamping jaws from the other side. When joining together the two housing halves, clamping jaws are now clamping the two legs to the contact element. Since both the structure as well as also the clamping jaws are electrically conductive, both housing halves have electrical contact. If at least one stop bevel is provided, the pressure increases when the two housing halves are "closed."

Pursuant to an advantageous embodiment of the disclosure it is provided that the contact element is pressed into the conductor track mount. If the contact element is a cylindrical connector pin, then this connector pin is pressed into a through-hole (via) in the conductor track mount. The contact element is preferably designed as a cylindrical connector pin.

Pursuant to a further preferred embodiment of the disclosure it is provided that the distribution device comprises at least one guide device for guiding the housing halves when they are joined together. This guide device may comprise a guide pin, for example.

Advantageously two contact elements which are in particular symmetrically attached and are in electrical contact on at least one conductor track mount are provided, wherein a first of the contact elements is circumferentially gripped by a U-shaped structure of the first housing half and the second of the contact elements is circumferentially gripped by a U-shaped structure of the second housing half and a respective clamping device of the respective other housing half clamps the legs of the U shape of each one of the housing halves to the assigned contact element.

In particular it is provided that the electrically conductive housing comprises breakthroughs for coating the conductor track mount inside the housing after the housing parts have been joined together.

Pursuant to an advantageous embodiment of the disclosure it is provided that the conductor track mount moreover comprises sleeves for the centering guidance of the conductor elements of the connectors. These sleeves are preferably pressed into the conductor track mount, in particular the plated through-holes of the conductor track mount.

If the housing has appropriate breakthroughs, then the conductor track mount/s within the interior of the housing can be subsequently coated with an electrically insulating material. Pursuant to a further advantageous embodiment of the invention it is provided that the conductor track mount in the interior of the housing is coated with an electrical insulating material.

The disclosure furthermore relates to a method for assembly of an electrical distribution device, in particular of a distribution piece, for connection on line and/or connecting devices with shielding devices. The distribution device comprises a conductive housing with conductive housing parts for forming a shielding of the distribution device and at least one conductor track mount arranged in a housing for interconnecting the contact elements of the various connectors with one another. The shielding devices are conductively connected via the conductor track mount with at least one contact element which is attached on it. At least one of the housing parts has at least one structure with at least one elastic contact projection for making electrical contact with the contact element and another of the housing parts has at least one clamping device with two clamping jaws which clamps the contact projection to the contact element when the housing parts are joined together and in this context provides electrical contact. Pursuant to an advantageous embodiment of the disclosure it is provided that the clamping device clamps the contact projection to the contact element by means of a stop bevel.

In particular it is provided that the conductor track mount is subsequently coated inside the conductive housing with an electrical insulating material through at least one breakthrough in the housing.

BRIEF DESCRIPTION OF THE DRAWINGS

In the following, the disclosure is discussed in detail with reference to the enclosed drawings by means of preferred embodiments, as following.

DETAILED DESCRIPTION OF PREFERRED EMBODIMENTS

Figure 1:
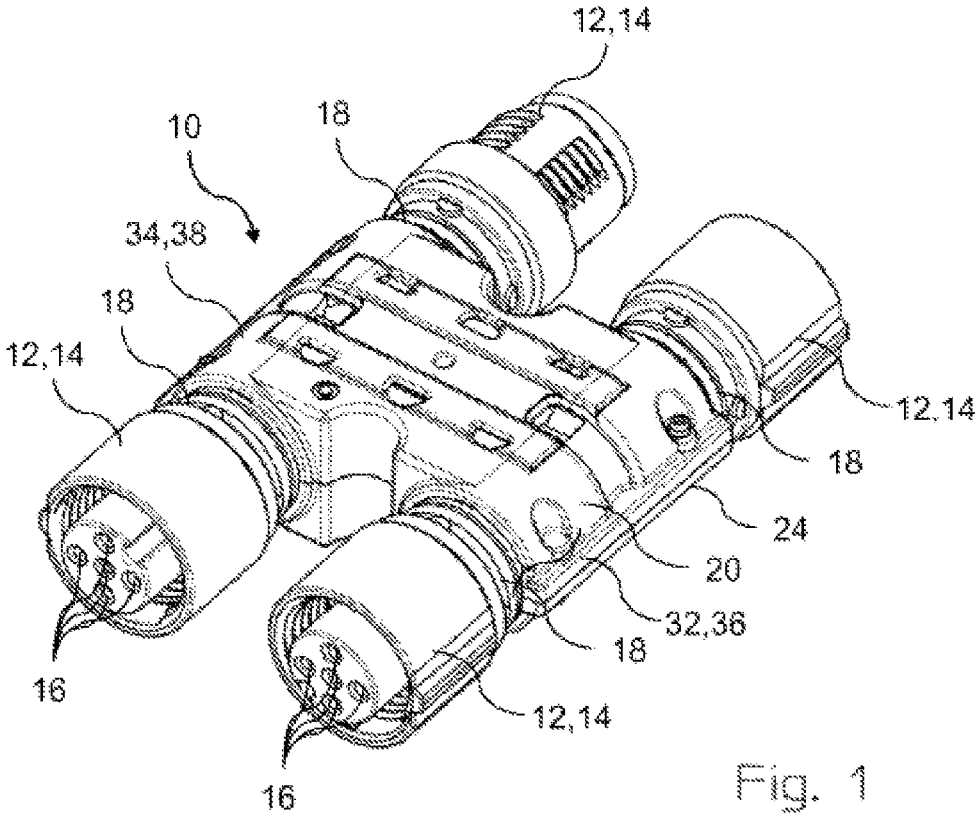
FIG. 1 shows a perspective illustration of the distribution device designed as an H-piece pursuant to a preferred embodiment of the disclosure.

FIG. 1 shows a distribution device 10 designed as a distribution piece, more precisely as an H-piece, with four line and/or connecting devices 12. Each of the line and/or connecting devices 12 is designed as a connector 14 and comprises a set of conductive elements 16 guided in a plug insert. Furthermore, each of the line and/or connecting devices 12 comprises a shielding device 18 designed as a shielded sleeve. Between the line and/or connecting devices 12 an interior space 22 of the distribution device 10 is located within a housing 20 of the distribution device (10) which is housed by this housing 20 and the line and/or connecting devices 12. On each of the sides of the distribution device 10 designed as an H-piece a pair of connectors is arranged with two each connectors 14 which are aligned reciprocally parallel. Each of the connectors 14 of one of the two connector pairs for this purpose is coaxially arranged to a corresponding connector 14 of the other connector pair on the opposite side of the distribution device 10. Because of this arrangement and the interior space 22 of the distribution device 10 which extends across the full width of the side, the characteristic H-form of the H-piece results.

In the center part 24 with interior space 22 of the distribution device 10, two reciprocally parallel arranged conductor track mounts 26, 28 which extend across the width are arranged. Both of these are designed as rigid circuit boards. The one of the conductor track mounts 26 is assigned to the one connector pair, the other of the conductor track mounts is assigned to the other connector pair. In each of the conductor track mounts 26, 28, pins and/or sleeves 30 are mutually pressed in for contacting the respective conductor track mount 26, 28 with the assigned line and/or connecting devices 12 and/or the two conductor track mounts 26, 28.

Figure 2:
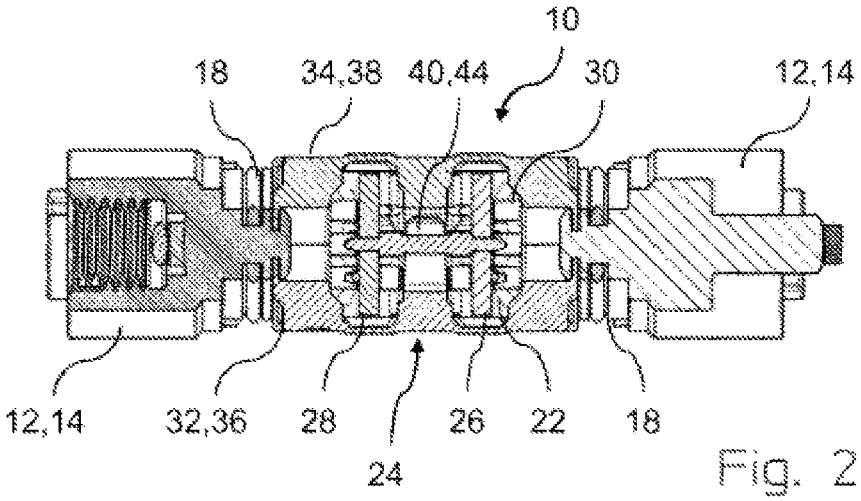
FIG. 2 shows a sectional lateral view of the H-piece shown in FIG. 1.

FIG. 2 shows the corresponding situation in a sectional lateral view. The part of the sleeves 30, which serve for providing electrical contact of the set of conductive elements 16 of the individual line and/or connecting devices 12, are connected with the individual conductive elements for that purpose. The conductor track mounts 26, 28 have conductive tracks (not shown here) for interconnecting the sets of conductive elements 16 of the different line and/or connecting devices 12.

The housing 20 is formed from two housing parts 36, 38 designed as housing halves 32, 34. The two housing halves 32, 34 are designed as housing half-shells, which completely overlap) (360°) the interior space 22 with the conductor track mounts 26, 28 in the assembled state. The distribution device 10 moreover comprises two contact elements 40, 42, which connects the two conductor track mounts 26, 28 to one another rigidly while at the same time providing electrical contact. Both contact elements 40, 42 are designed as cylindrical contact pins 44, 45, which with their respective end sections are pressed into the one conductor track mount 26 as well as into the other conductor track mount 28.

Each of the housing halves 32, 34 comprises a structure 46, 48 on its respective inside, wherein each of the structures 46, 48 has two contact projections 50, 52. In this context, each of the structures 46, 48 is designed as a U-shaped structure with elastic legs of the U-shaped designed contact projections 50, 52.

Each of the housing halves 32, 34 furthermore comprises a clamping device 54, 56 with two each clamping jaws 58, 60 which are arranged reciprocally spaced apart. The corresponding distance A between the inside legs of the clamping jaws 58, 60 approximately corresponds to the outside distance of the two contact projections 50, 52 designed as elastic legs of the structure 46, 48 of the respective other housing half 32, 34. Each of the clamping jaws 58, 60 comprises a stop bevel 62, 64 on its inside, so that the distance of the clamping jaws at the base of the respective clamping device 54, 56 is smaller than the distance between the end sections of the clamping jaws 58, 60.

Each of the housing halves 32, 34 furthermore comprises a guide device 66, 68 for guiding the housing parts when they are joined together.

This results in the following function: If the line and/or connecting devices 12 are connected to the respective conductor track mounts 26, 28 and these are contacted electrically to one another by means of the contact elements 40, 42 designed as contact pins 44, 45, then the conductor track mounts 26, 28 are inserted into one of the housing halves 32, 34. In this context, the essentially U-shaped structure 46 of the one housing half 32 overlaps the one contact element 40, so that this is arranged with one of its sections between the contact projections 50, 52 designed as elastic legs. For this purpose, the second contact element 42 is in the area of the clamping device 58 of the first housing half 32.

Figure 3:
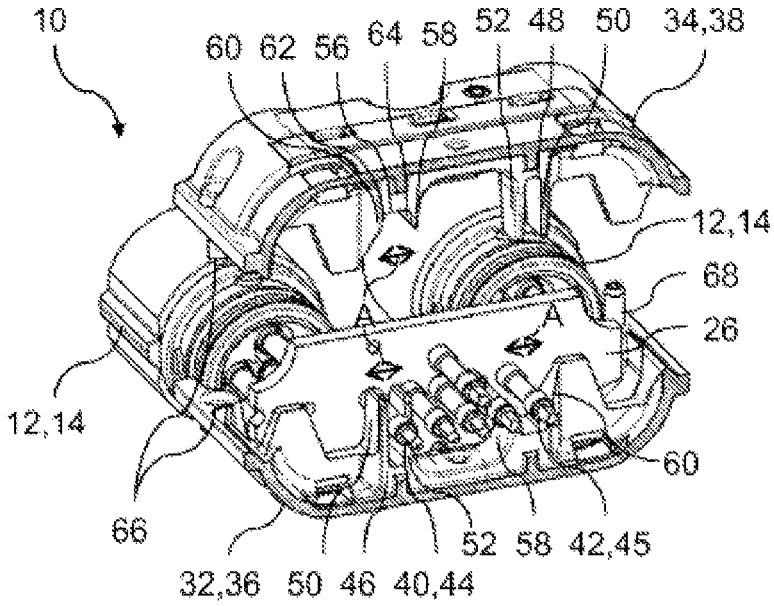
FIG. 3 is a perspective illustration of a transverse cross-sectional view of the H-piece of FIG. 1, wherein one housing half is raised.

FIG. 3 illustrates the corresponding situation. If the second housing half 34 is mounted, i.e. it joins the two housing halves, then the clamping device 56 of the second housing half 34 overlaps the ends of the contact projections 50, 52 of the U-shaped structure 46 of the first housing half 32 and in this context clamps the corresponding contact projections 50, 52 of the structure 46 to the first contact element 40 through the increasing pressure which occurs during the assembly by means of the stop bevels 62, 64.

Figure 4:
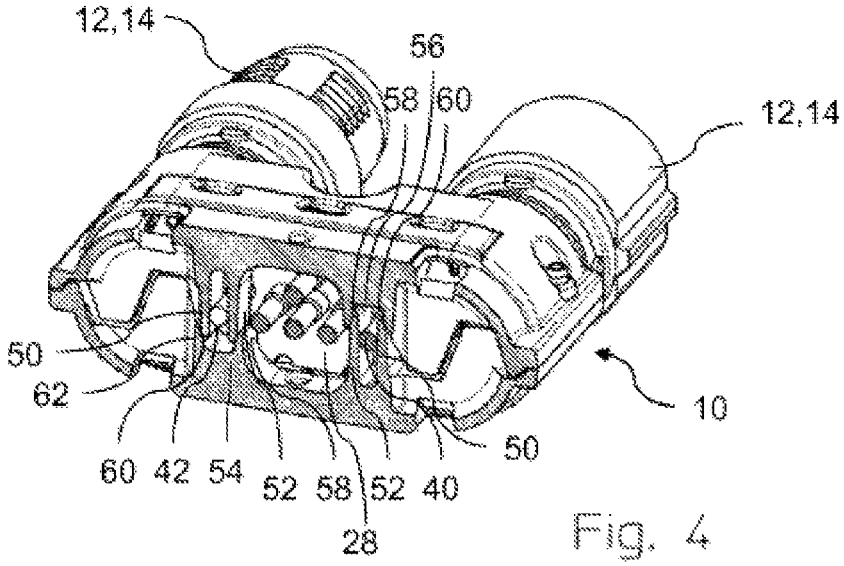
FIG. 4 is a perspective illustration of the other half of the transverse cross-sectional view of the H-piece of FIGS. 1 to 3 with the housing halves joined together.

The same also occurs with the second contact element 42. Here, the clamping jaws 58, 60 of the clamping device 54 of the first housing half 32 overlap the ends of the contact projections 50, 52 of the second structure 48 of the second housing half 34, and through the increasing pressure resulting during the assembly because of the stop bevels 62, 64, clamps the contact projections 50, 52 to the contact element 42. The corresponding situation with a view to the other side of the distribution device 10 is illustrated in FIG. 4.

With the distribution device 10 illustrated in FIGS. 1 to 4, the electrically conductive housing 20, consisting of the housing halves 32, 34, is therefore connected easily and securely to the conductor track mounts 26, 28 with the shielding devices of the connectors 12. By clamping together the contact projections 50, 52 and the contact elements 40, 42, both housing halves 32, 34 are securely provided with electrical contact.

At least one of the housing parts 36, 38, i.e. the housing halves 32, 34, has a breakthrough through which the conductor track mounts 26, 28 in the interior space 22 of the distribution device 10 are coated with electrically insulating material after joining together the housing parts 36, 38.

Because of the two conductive housing halves 32, 34, which can be identically designed, EMC shielding is therefore accomplished. This shielding of the distribution device 10 can be combined both with connectors as well as with shielded lines. The interconnections inside the distribution device 10 are totally encapsulated in this context. The shielding can therefore be optionally integrated in the interconnections.

LIST OF REFERENCE SYMBOLS

Distribution device 10
Line and/or connecting devices 12
Connector 14
Set of conductive elements 16
Shielding device 18
Housing 20
Interior space 22
Center part 24
Conductor track mount 26
Conductor track mount 28
Sleeve 30
Housing half 32
Housing half 34
Housing part 36
Housing part 38
Contact element 40
Contact element 42
Contact pin 44
Contact pin 45
Structure 46
Structure 48
Contact projection 50
Contact projection 52
Clamping device 54
Clamping device 56
Clamping jaw 58
Clamping jaw 60
Stop bevel 62
Stop bevel 64
Guide device 66
Guide device 68

The invention claimed is:

1. An electrical distribution device, in particular a distribution piece, for connection to line and/or connecting devices which have shielding devices, wherein the distribution device has a conductive housing for forming a shielding, and has at least one conductor track mount, which is arranged in the housing, for connection of the various line and/or connecting devices, characterized in that the shielding devices are conductively connectable via the conductor track mount to at least one contact element which is attachable to said mount, and the housing has conductive housing parts wherein at least one of the housing parts has at least one structure with at least one elastic contact projection for making electrical contact with the attached contact element, and another of the housing parts has at least one clamping device with two clamping jaws for clamping the contact projection to the attached contact element when the housing parts are joined together.

2. The distribution device according to claim 1, wherein the conductor track mount comprises the contact element and the shielding devices are conductively connected via the conductor track mount with the contact element which is attached to said mount.

3. The distribution device according to claim 1, wherein the housing parts are designed as two housing halves, in particular as housing half-shells.

4. The distribution device according to one of the claim 1, wherein the contact projection and/or at least one of the clamping jaws has a stop bevel for clamping the contact projection with the contact element.

5. The distribution device according to claim 1, wherein the structure is an essentially U-shaped structure with two contact projections designed as two elastic legs of the U-shape for circumferentially gripping the contact elements, and the clamping jaws are designed for clamping both sides of the contact projections to the contact element when the housing parts are joined together.

6. The distribution device according to claim 1, wherein the contact element is pressed into the conductor track mount.

7. The distribution device according to claim 1, wherein the contact element is designed as a cylindrical connector pin.

8. The distribution device according to claim 1, characterized by at least one guide device for guiding the housing parts when they are joined together.

9. The distribution device according to claim 1, wherein the conductor track mount furthermore comprises sleeves for its electrical linking to the shielding devices.

10. The distribution device according to claim 1, wherein the conductor track mount in the interior space of the housing is coated with electrically insulating material.

11. A method for assembly of an electrical distribution device, in particular a distribution piece for connection to line and/or connecting devices with shielding devices, wherein the distribution device has a conductive housing with conductive housing parts for forming a shielding of the distribution device and has at least one conductor track mount which is arranged in the housing for interconnecting conducting elements of the various connectors with one another and the shielding devices are conductively connected via the conductor track mount to at least one contact element which is attached to said mount, and at least one of the housing parts has at least one structure with at least one elastic contact projection for making electrical contact of the contact element and another of the housing parts has at least one clamping device with two clamping jaws for clamping the contact projection to the contact element when the housing parts are joined together and makes electrical contact for this purpose.

12. The method according to claim 11, wherein the clamping device clamps the contact projection to the contact element by means of a stop bevel.

* * * * *